US010220242B2

(12) United States Patent
Matos

(10) Patent No.: US 10,220,242 B2
(45) Date of Patent: Mar. 5, 2019

(54) BATTLE ROPE STRENGTH TRAINER

(71) Applicant: Jose Matos, New Windsor, NY (US)

(72) Inventor: Jose Matos, New Windsor, NY (US)

( * ) Notice: Subject to any disclaimer, the term of this patent is extended or adjusted under 35 U.S.C. 154(b) by 3 days.

(21) Appl. No.: 15/617,357

(22) Filed: Jun. 8, 2017

(65) Prior Publication Data

US 2017/0368405 A1 Dec. 28, 2017

Related U.S. Application Data

(60) Provisional application No. 62/493,235, filed on Jun. 27, 2016.

(51) Int. Cl.

| | |
|---|---|
| ***A63B 21/08*** | (2006.01) |
| ***A63B 23/12*** | (2006.01) |
| ***A63B 21/06*** | (2006.01) |
| ***A63B 23/02*** | (2006.01) |
| ***A63B 23/035*** | (2006.01) |
| ***A63B 21/00*** | (2006.01) |

(Continued)

(52) U.S. Cl.

CPC ..... *A63B 21/151* (2013.01); *A63B 21/0004* (2013.01); *A63B 21/00061* (2013.01); *A63B 21/00069* (2013.01); *A63B 21/068* (2013.01); *A63B 21/08* (2013.01); *A63B 21/169* (2015.10); *A63B 21/1654* (2013.01); *A63B 21/4034* (2015.10); *A63B 21/4035* (2015.10); *A63B 22/0002* (2013.01); *A63B 23/0222* (2013.01); *A63B 23/0233* (2013.01); *A63B 23/03541* (2013.01); *A63B 23/0405* (2013.01); *A63B 23/1209* (2013.01); *A63B 23/1218* (2013.01); *A63B 21/4043* (2015.10); *A63B 2209/00* (2013.01); *A63B 2225/093* (2013.01)

(58) Field of Classification Search

CPC . A63B 23/1209; A63B 21/151; A63B 21/169; A63B 21/0609; A63B 21/08; A63B 21/4043; A63B 21/4034; A63B 21/4035; A63B 21/4023; A63B 23/12; A63B 23/03541; A63B 23/0222; A63B 23/0233; A63B 23/0405

See application file for complete search history.

(56) References Cited

U.S. PATENT DOCUMENTS 843,478 A * 2/1907 Muller ..... A63B 21/0552 482/124

2,716,027 A * 8/1955 Gehri ..... A63B 21/023 482/131

(Continued)

*Primary Examiner* — Daniel J Colilla

(57) ABSTRACT

In some embodiments, a battle rope strength trainer device is provided. The battle rope strength trainer device provides a multifunction exercise device that combines strength building properties of body weight strength exercises with the cardiovascular training of battle rope oscillation exercises in one product. In one embodiment, the battle rope strength trainer device includes an anchor, a rope and a mounting device. The rope includes a first end coupled to the anchor and two free ends. The first end is attachable to a structure via the anchor and the two free ends are positioned opposite to the first end. The mounting device is coupled to the structure above the anchor. In that regard, the mounting device is adapted to receive a portion of the rope associated with each of the two free ends to enable movement of the rope for a plurality of exercises.

19 Claims, 5 Drawing Sheets

(51) Int. Cl.

| | |
|---|---|
| ***A63B 21/16*** | (2006.01) |
| ***A63B 21/068*** | (2006.01) |
| ***A63B 22/00*** | (2006.01) |
| ***A63B 23/04*** | (2006.01) |

(56) References Cited

U.S. PATENT DOCUMENTS

| | | | | |
|---|---|---|---|---|
| 2014/0113777 | A1* | 4/2014 | Pahl | A63B 21/4043<br>482/93 |
| 2014/0141946 | A1* | 5/2014 | Huber | A63B 21/15<br>482/110 |
| 2015/0265869 | A1* | 9/2015 | Hemstreet | A63B 21/015<br>482/110 |
| 2015/0283421 | A1* | 10/2015 | Gaylord | A63B 21/151<br>482/110 |

* cited by examiner

BATTLE ROPE STRENGTH TRAINER

CROSS REFERENCE TO RELATED APPLICATION

This application claims the benefit of U.S. Provisional Patent Application No. 62/493,235, filed Jun. 27, 2016, the entire disclosure of which is incorporated herein by this reference.

TECHNICAL FIELD

Embodiments of the present disclosure relate generally to an exercise device, and more specifically, but without limitation, to a battle rope strength trainer.

BACKGROUND

Given a host of health problems that can arise from a relatively-sedentary lifestyle and improper exercising techniques, there is a renewed interest in personal fitness and preventative healthcare. Consequently, there is now an abundance of fitness equipment improve the physical fitness of users. Even with so many pieces of fitness equipment on the market, there are ongoing efforts to provide better equipment.

BRIEF DESCRIPTION OF THE DRAWINGS

The disclosure will be understood more fully from the detailed description given below and from the accompanying drawings of various embodiments of the disclosure. The drawings, however, should not be taken to limit the disclosure to the specific embodiments, but are for explanation and understanding only.

DETAILED DESCRIPTION

Figure 1:
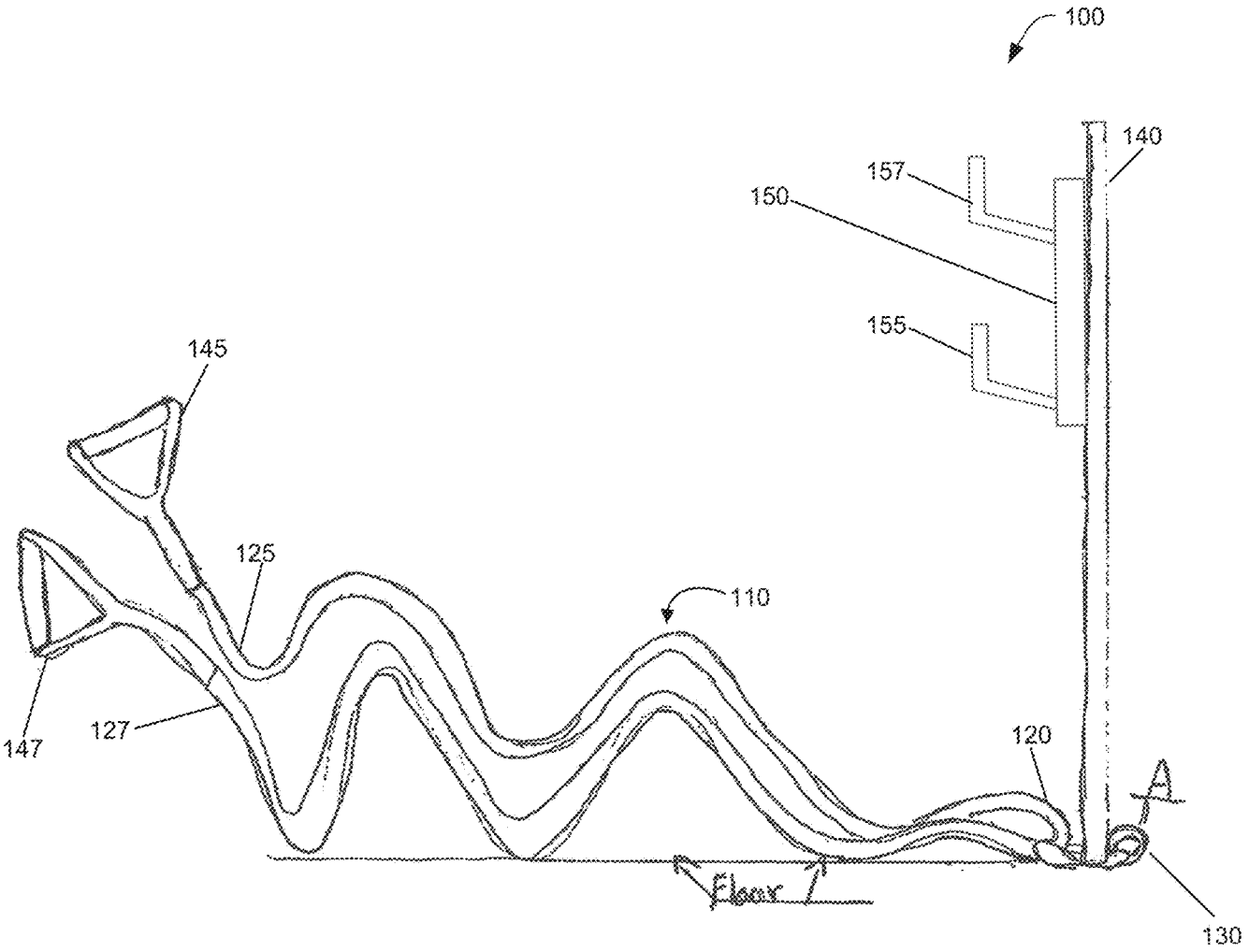
FIG. 1 is an illustration of an example of a battle rope strength trainer device in accordance with embodiments of the disclosure.

Physical fitness is commonly achieved by engaging in a type of exercise training. One type of exercise training uses bodyweight suspension strength devices to improve muscular fitness. Such devices may allow a user to exercise their muscles by providing resistance to the movement of a user's arms, legs, and/or or torso. Another type of exercise training uses certain devices to improve cardiovascular fitness. For example, these devices may facilitate any movement that gets the user's heart rate up and increases blood circulation throughout their body.

Training to improve both cardiopulmonary and muscular fitness often requires a variety of exercises, which may demand a user to engage multiple fitness devices. Such equipment can be space consuming and may not facilitate a wide range of stances and exercises that provide the user's motion in a form that is useful for physical training. Moreover, many systems that do provide physical training are often limited in the muscular groups that the user can exercise and/or lack the means to train different muscle groups (such as the arms, chest, legs, torso and back) with the same device.

Implementations of the disclosure address the above-mentioned and other deficiencies by providing a battle rope strength trainer. The battle rope strength trainer is a multi-function exercise device that combines the benefits of body-weight suspension strength exercises with rope oscillation exercises in one system. This rope oscillation exercise is also referred to as a "Battle Rope" exercise. The Battle Rope exercise includes one or more ropes coupled to a structure (such as a wall) in a manner so that two free ends are formed opposite the structure. The two free ends are each attached to portions of the rope that are of a certain length. During workouts, the user trains with the ropes by holding each free end in hand in order to vibrate the ropes using physical strength. For example, the user may grasp each free end of the rope while the opposing end is secured to the wall. The user begins to oscillate the rope by moving each hand up and down to create a type of wave. The shape of the wave may dictate how intense the workout is for the user.

In some implementations, the battle rope strength trainer includes a rope component. The strength properties of the rope to allow users to perform additional strength training by providing resistance to the movement of a user's arms, legs, or torso for a variety of different exercises. For example, the battle rope strength trainer may include a multi-function mounting device that is adapted to receive a portion of the elastic rope. In that regard, the free ends of the rope are fed through the mounting device so that the trainer can be configured to enable strength training exercises, such as chest flys, high rows, reverse crunch and/or other types of strength training exercises.

In other embodiments, the battle rope strength trainer may include straps (e.g., nylon straps) attached to each handle, which allows for additional exercises for training different muscle groups of the users. Each handle, in embodiments, may also include a slip-resistant grip padded foam area for the exercising user to comfortably grip the handles during workouts. In further embodiments, the free ends of the ropes may include weight clamps. The weight clamps may be attached to the rope near the handles for added resistance. In view of the various configurations of the battle rope strength trainer, additional advantages may be achieved to overcome the deficiencies in current exercise systems by providing a single compact system incorporating both cardiopulmonary and muscular fitness exercises to improve the overall physical fitness of users.

FIG. 1 is an illustration of an example of a battle rope strength trainer device 100 in accordance with embodiments of the disclosure. In some embodiments, the battle rope strength trainer device includes a rope 110 and a mounting device 150. The mounting device 150 is adapted to receive a portion of the rope 110 to allow a user to perform a plurality of different exercises that combines the benefits of bodyweight suspension strength exercises with rope oscillation exercises. These exercises may include, but are not limited to, battle rope oscillations, slams, chest fly, high row, reverse crunch, etc.

In some embodiments, the rope 110 is comprised of an elongated, pliable and. This rope 110 can be of varying lengths. For example, the rope 110 can be 20-30 feet long, although other sizes are possible. In some embodiments, the rope 110 can be a determined diameter, for example, 2 or 3 inches in diameter, and vary in weight depending upon the rope's length and diameter. The rope 110 can be comprised of various types of materials, such as a type of nylon, which provides a certain amount of resistance when the rope is pulled. In some embodiments, the rope 110 may be covered in a type of polymer material to protect the rope 110 from excessive wearing, ripping or tearing.

As shown in FIG. 1, the rope 110 includes a first end 120 and two free ends 125 and 127. For example, the rope 110 may be bent (e.g., folded, etc.) at the first end 120 and fixed to a structure 140 (e.g., a wall) so that two free ends 125 and 127 are formed. In this example, a single rope 110 is used. In alternative examples, two ropes may be used to create the two free ends 125. During exercises, a user holds each of the two free ends 125 and 127 of the rope 110 in hand and commences strength training by movement of the arms and upper body on a floating portion of the rope 110 between the first end 120 and the two free ends 125. This activity provides a training effect for various muscle groups in the arms, chest and back.

To fix the rope 110 to the structure 140 so that the two free ends 125 and 127 are formed, the device 100 may further include an anchor 130. This anchor 130 may be positioned at a central portion of the rope 110 so that the portions of the rope 110 between the first end 120 and the two free ends 125 and 127 are substantially equal. The anchor 130 may be, for example, a clamp, chain, or other type of securing device. In some embodiments, the anchor 130 may be coupled to the first end 120 of the rope 110 and is adapted to attach the first end 120 to the structure 140. For example, the rope 110 may be fed through an opening in the anchor 130 so that a central portion of the rope 110 is positioned in the anchor 130. In alternative embodiments, the anchor 130 may be attached the structure 140 and opens to clamp onto the first end 120 of the rope 110. In some embodiments, the structure 140 may be a wall of a building (such as a gym). In other embodiments, the structure 140 may be a door, bar or other type of structure that can secure the first end 120 of the rope 110 from moving forward when the user is exercising using the two free ends 125 and 127 of the rope 110.

For the user to perform certain exercisers, the battle rope strength trainer device 100 may further include handles 145 and 147, respectively attached to each of the two free ends 125 and 127 of the rope 110. For example, handle 145 may be attached to free end 125 and handle 147 may be attached to free end 127 of the rope 110. In some embodiments, the handles 145 and 147 may be of varying handle shapes without substantially departing from the scope of the disclosure. When the handles 145 and 147 are included, the user may grip the handles 145 and 147 of the rope 110 to enable performance of various exercises in accordance with the disclosure. For example, the user may exert a pulling force against the tension placed on the rope 110 to exercise upper and lower body group muscles, such as the deltoids, triceps, back and leg muscles. In some embodiments, the handles 145 and 147 may be placed over the user's legs to perform certain strength training exercises. Further aspects of the handles 145 and 147 and exercises that use the handles 145 and 147 are discussed below with respects to FIGS. 2-4.

With respect to FIG. 1, the battle rope strength trainer device 100 may further include a mounting device 150. In some embodiments, the mounting device 150 may be made of various types of material, such as a type of metal, plastic, etc. The mounting device 150 may be coupled to the structure 140 using, for example, screws, bolts and other types of securing devices. In some embodiments, the mounting device 150 can be coupled to the structure 140 above the first end 120 of the rope 110. For example, the mounting device 150 may be positioned so that it is a certain adjustable height above where the first end 120 is attached to the structure 140. Some advantages of positioning the mounting device 150 at different heights above the first end 120 is that it allows the user to perform additional exercises using the battle rope strength trainer device 100, such as a seated pull up.

The mounting device 150, in embodiments, is adapted to receive a portion of the rope 110 associated with each of the two free ends 125 and 127. For example, each of the two free ends 125 and 127 can be fed through or otherwise attached to a portion of the mounting device 150. In that regard, the mounting device 150 may include one or more anchor points, such as a first anchor point 155 and a second anchor point 157. The rope 110 may be positioned so that a portion attached to each free end 125 and 127 hangs from one of the first or second anchor points 155, 157. By positioning the rope 110 with respect to the mounting device 150, the user is able to perform a plurality of exercises using the resistance properties of the rope 110. These exercises may include, but are not limited to, chest flys, high rows, reverse crunch, and other types of strength training exercises.

Figure 2:
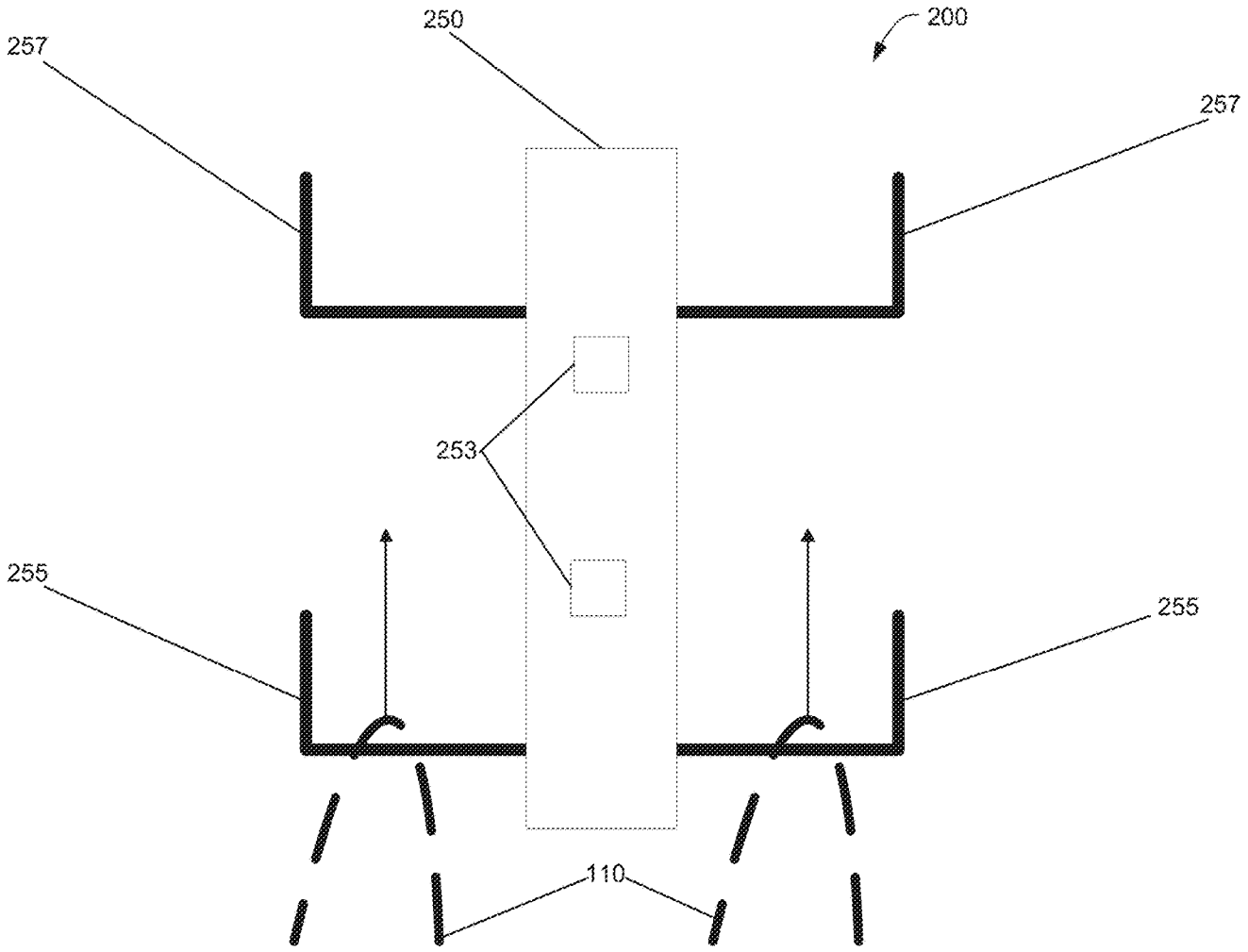
FIG. 2 is an illustration of an example of a mounting device in accordance with embodiments of the disclosure.

FIG. 2 is an illustration of an example of a mounting device 200 in accordance with embodiments of the present disclosure. This mounting device 200 may be the same as the mounting device 150 of FIG. 1. For example, mounting device 200 may include a first anchor point 255 (which may be the same as the first anchor point 155) and a second anchor point 257 (which may be the same as the second anchor point 157). The mounting device 200, in embodiments, is adapted to receive a portion of the rope 110. For example, the rope may be fed through or otherwise attached to a portion of the mounting device 150 at either the first anchor point 255 or the second anchor point 257. The position of the rope 110 with respect to the mounting device 200 allows a user to perform a plurality of different training exercises utilizing the resistance properties of the rope 110.

The mounting device 200, in embodiments, may include a main body portion 250. The main body portion 250 may be made of various rigid materials, such as a type of plastic, or metal. The main body portion 250 of the mounting device 200 may be constructed in various forms. In this example, the main body portion 250 is rectangular in shape. In some embodiments, the main body portion 250 may include one or more ports 253. The ports 253 are adapted to receive a securing device (not shown), such as a screw, nail, bolt or other types of securing devices to attach the mounting device 200 to a structure (e.g., a wall).

In some embodiments, the mounting device 200 includes one or more anchor points 255 and 257. The anchor points 255 and 257 can be attached, respectively to a first level and a second level of the mounting device 200. For example, the first anchor point 255 may be attached to the first level and the second anchor point 257 may be attached to the second level of the mounting device 200. In some embodiments, the anchor points 255 and 257 are constructed along with the main body portion 250. In other embodiments, the anchor points 255 and 257 may be constructed separately and later attached to the main body portion 250 of the mounting device 200. The anchor points 255 and 257, in embodiments, are made of the same material as the main body portion 250, such as type of plastic or metal. In other embodiments, the anchor points 255 and 257 can be made of a different material.

The anchor points 255 and 257 can be formed into various shapes. As shown in FIG. 2, the anchor points 255 and 257 are shaped to form a ninety-degree angle (similar to a football goal post). In other embodiments, the anchor points 255 and 257 can be shaped as rings or other types of shapes that can receive and hold portions of the rope 110 in place.

To position the rope 110 at the mounting device 200, a user may engage each of the two free ends 125 and 127 of the rope 110 with a level of the mounting device 200. For example, each of the two free ends 125 and 127 of the rope 110 can be fed through or otherwise attached to on of the members 255 and 257. The rope 110 may be positioned so that a portion attached to each free end hangs from one of the levels 255, 257 of the mounting device 150. Typically, both portions of the rope 110 associated with each free end 125, 127 are arranged at the same level of the mounting device 200. Based on the positioning of the rope 110 with respect to the mounting device 200, the user is able to perform a plurality of different exercises using the resistance properties of the rope 110.

Figure 3:
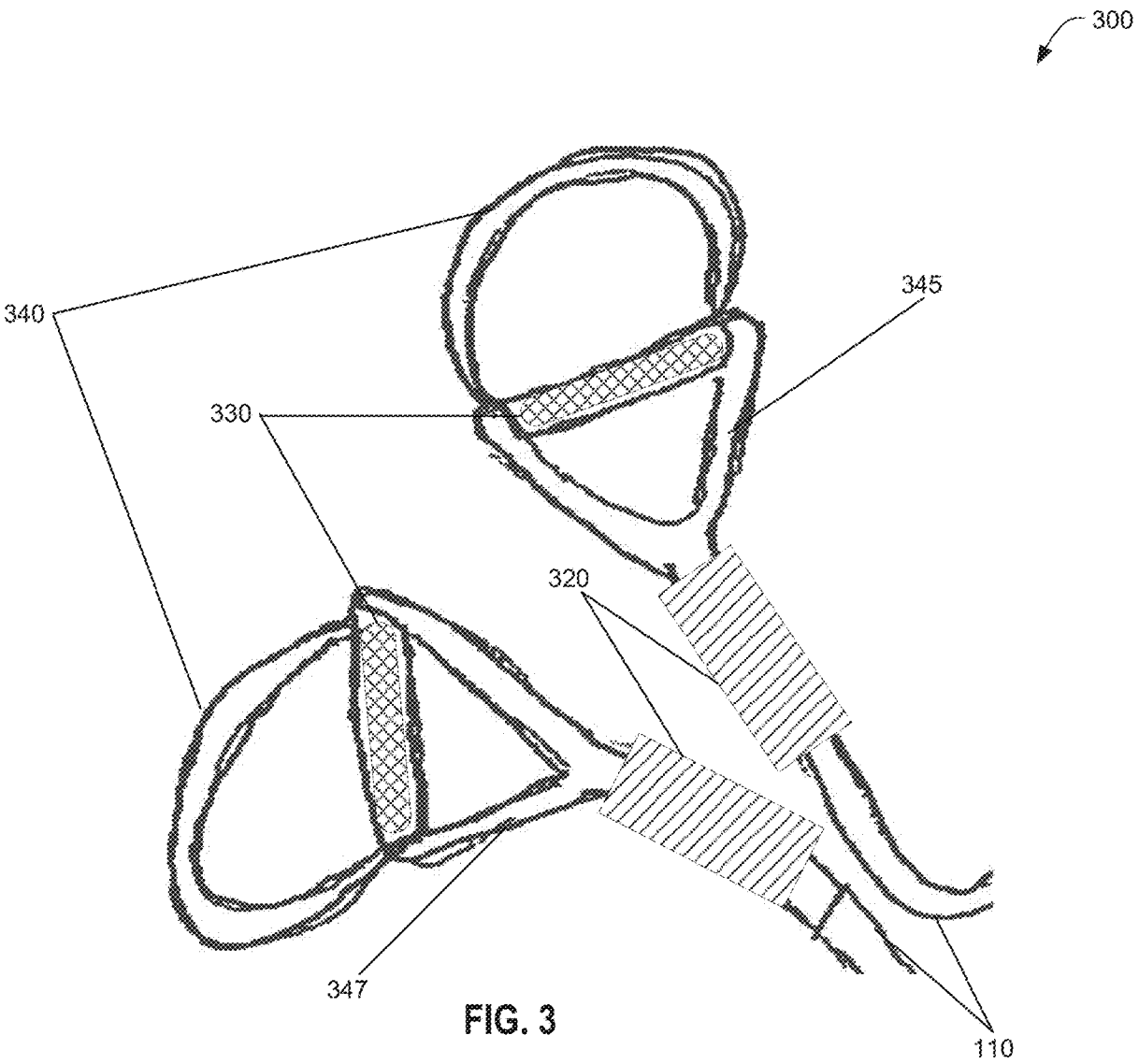
FIG. 3 is an illustration of an example of handles in accordance with embodiments of the disclosure.

FIG. 3 is an illustration of an example 300 of handles 345, 347 in accordance with embodiments of the disclosure. In this example, the handles 345 and 347 (which may be same as handles 145 and 147 of FIG. 1) are respectively attached to each of the two free ends of the rope 110. In some embodiments, the handles 345 and 347 ray be of varying handle shapes without substantially departing from the scope of the disclosure. When the handles 345 and 347 are included, the user may grip the handles 345 and 347 of the rope 110 do to various exercises in accordance with the disclosure. For example, the user may exert a pulling force against the tension placed on the rope 110 to exercise upper and lower body group muscles such as the deltoids, triceps, back and leg muscles. In some embodiments, the handles 345 and 347 may be placed over the user's legs to perform certain strength training exercises.

In some embodiments, each of the handles 345,347 may include a strap 320. For example, the strap 320 may be fastened to each handle to form a circuitous flexible object over each the end of the rope 110. The strap 320 allows the rope 110 to be fixed to the hand or feet of a user, for example, during exercises workout. The strap 320 is made from a flat length of flexible material, such as nylon, although other types of material can be used. The strap 320 has the beneficial effects that the structure is compact and is firmly fixed to the rope 110 to assist the user in preventing the rope from slipping through their hands or feet during a vigorous workout.

In some embodiments, each of the handles 345, 347 may further include pads 330. For example, the pad 330 can be removably secured to either end of handles 330. The pads 330 can optionally be provided to the handles 345 and 347 to provide additional cushioning if desired. The pads 330 may be made of various types of materials, such as a type of foam or rubber, which provide cushioning when the handles 345 and 347 are griped by the user. The pads 330 can be placed over each of the handles 345 and 347, thereby creating slip-resistant grip areas or handles for the exercising user.

To increase resistance for some exercise routines, the handles 345, 347 may be adapted to receive one or more weight clamps 340. The weight clamps 340 are comprised of weight ballasts and a curved hollow body portion for receiving a portion of the rope 110. For example, a quick release weight clamp 340 can include two crescent halves that can be coupled at one end of the rope 110. The weight clamps 340 may be arranged to have a different weight values (e.g., 6 lbs, 10 lb, 12 lb, etc.). In one embodiment, the different weight values are color-coded according to their corresponding weight value. An advantage of using the weight clamps 340 is that it provides additional weight resistance during particular exercises to better train certain large muscle groups. Examples of these types of exercises are further discussed below with respect to FIG. 4A-E.

FIG. 4A-E is an illustration of example exercises 460, 465, 470, 475, 480 using a battle rope strength trainer device 400 in accordance with embodiments of the disclosure. In this example, the device 400 may be the same as the battle rope strength trainer device 100 of FIG. 1. For example, device 400 includes a rope 410 (which may be the same as rope 110) attached to a structure 440 (e.g., a wall) via an anchor 430 (which may be the same as anchor 130). As shown, the battle rope strength trainer device 400 also includes a mounting device 450 (which may be the same as mounting device 150) coupled to the structure 440 above an end of the rope 430. The mounting device 450 is adapted to receive a portion of the rope 430 so that a user 401 may perform a combination of different types of oscillating and strength training exercises utilizing the resistance properties of the rope 410.

Figure 4A:
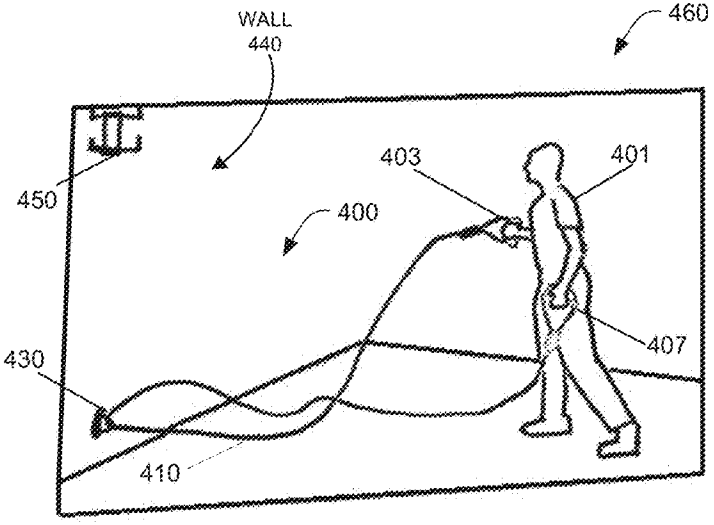
FIGS. 4A-E are illustrations of example exercises using a battle rope strength trainer device in accordance with embodiments of the disclosure.

As shown in FIG. 4A, one of the exercises that can be performed using the battle rope strength trainer device 400 is a battle-rope oscillation exercise 460. This exercise is intended to serve as a full body workout, as well as a cardio trainer. During this workout exercise 460, the user 410 sets the rope 410 by physical strength to vibrate. Here, the user holds free ends 403 and 407 of the rope 410 in hand and commences the battle-rope oscillation exercise 460 by movement of the arms and the upper body strength to the rope to oscillate. For example, the user 401 may grasp each end 403 and 407 of the rope 410 in each hand while the opposing end 430 is secured or anchored to a physical object or structure (e.g., wall 440). The user 401 then begins to oscillate the rope 410 by moving each end 403 and 407 up and down to create a wave. This wave, along with the rope's parameters, dictates how intense the workout is. This battle-rope oscillation exercise 460 provides a training effect for different muscle groups in the arms, torso and back.

Figure 4B:
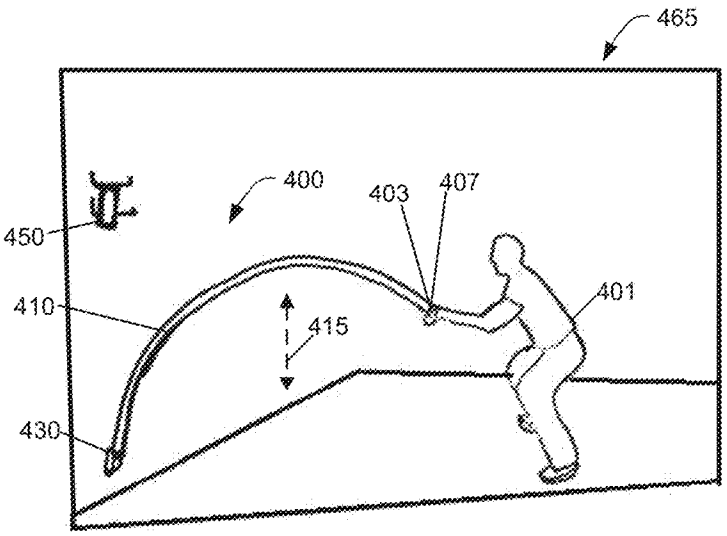

In FIG. 4B, a slam exercise 465 is shown using the rope 410. In this example, the use of the battle rope strength trainer device 400 may also include the movements as shown by the dashed lines 415. More particularly, instead of moving hands in opposite directions simultaneously in an upward and downward motions as referred to in FIG. 4A, the user 401's hands may be moved generally in unison upwardly and generally in unison downwardly. More particularly, FIG. 4B illustrates the right hand and left hand of user 401 moving ends 403 and 407 of rope 410 upward and downward generally together in a motion, which is often referred to in the use of rope 410 exercises as a "slam." For example, the user 401 may lift both arms as high as possible and then slam the rope 410 down to the ground as hard they can going as fast as possible. This exercise is also intended to serve as a full body workout, as well as a cardio trainer for various muscle groups.

Figure 4D:
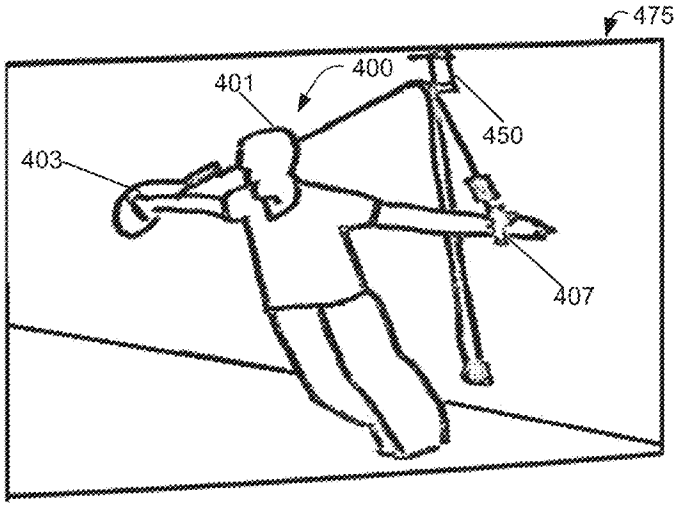
Figure 4C:
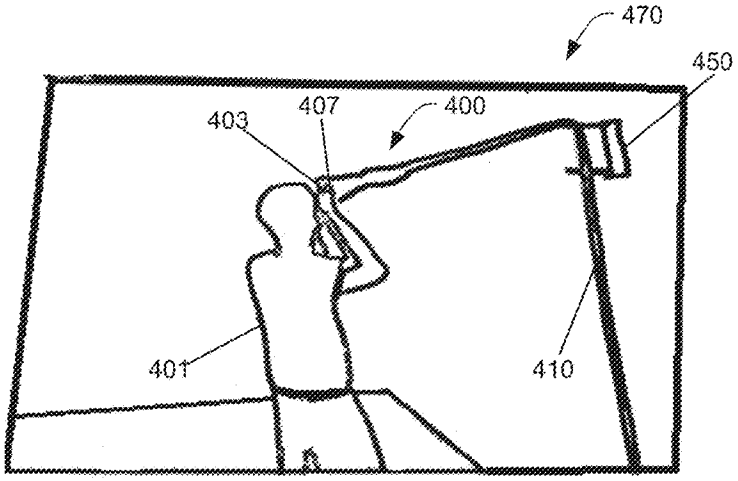

Turning to FIG. 4C, the battle rope strength trainer device 400 is shown configured for performing a bicep curling exercise 470. For example, as discussed above, the battle rope strength trainer device 400 can be used for resistance training exercise. By working different muscle groups using the resistance properties of the rope 410, the user 401 can increase muscle tone, increase strength and even maintain weight. In the example of FIG. 4C illustrating the bicep curling exercise 470, the user 401 may start in a standing pose in a slightly rearward-reclined position. The user 401 may engage the device 400 with movements to perform a bicep curling exercise 470. For example, the ends 403 and 407 of the rope 410 may be fed through the mounting device 450 so that it holds portions of the rope 410. The user 401 then grips the handle of the ends 403 and 407 and applies a pulling force that moves the ends 403 and 407 towards the user's body under resistance. Afterward, the user 401 may move the ends 403 and 407 from the user's body and then repeat the pulling step under the resistance of the rope 410. In that regard, the resistance of the rope 410 to the user 401 movements of the ends 403 and 407 helps to work the biceps and deltoid muscles of the user 401.

In FIG. 4D, the battle rope strength trainer device 400 is shown configured for performing a chest fly exercise 475 using the rope 410. A chest or pectoral ("pec") fly exercise 475 works the pectoral muscles, as well as the biceps and deltoid to a lesser extent. In a starting position, the user 410 may be in an upright and forwardly inclined position facing away from the mounting device 450. The user's 401 hands may grip each end 403 and 407 of the rope and extend laterally from opposite sides of the user 401. The user 401 then applies a pulling force that moves the ends 403 and 407 downward from the user's body under resistance. Next, the user 401 may move the ends 403 and 407 upward and then repeat the pulling step under the resistance of the rope 410.

Figure 4E:
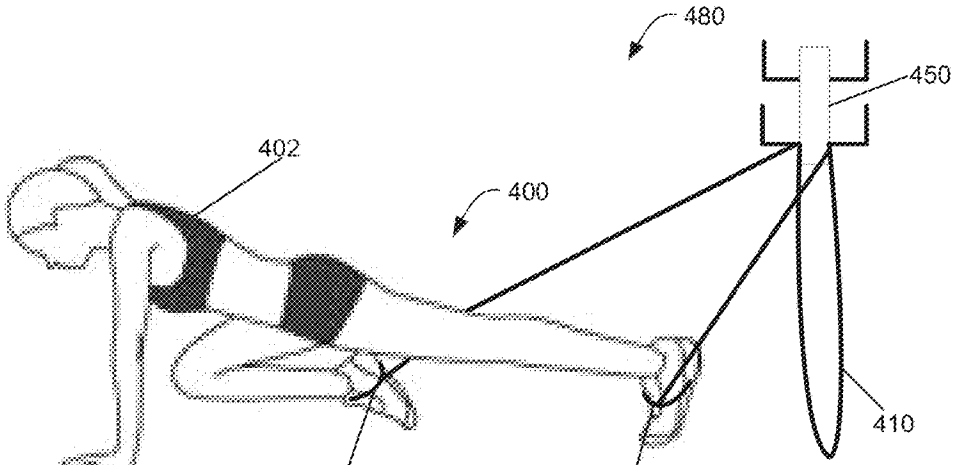

With respect to FIG. 4E, the battle rope strength trainer device 400 is shown configured to enable performance of a reverse crunch exercise 480. In this example, the reverse crunch exercise 480 works the user 402's entire core as well as their upper-body. The user 402 begins in a push-up position with their elbows extended, legs back straight and hands under your shoulders. Each end 403 and 407 of the rope 410 is attached to a foot of the user 302 while the mounting device 450 is holding portions the rope 410 in an elevated position. The user 402 then brings one or both knee towards the user's chest. For example, the user 402 brings one or both knees towards their chest then straightens them back out to the starting position. The benefits of the reverse crunch exercises using the battle rope strength trainer device 400 is that the resistance of the rope 410 to the user 401 movements of the ends 403 and 407 helps to work abs and leg muscles of the user 401.

The above-described example exercises are a few example exercises that the battle rope strength trainer device 400 can be configured for a user to perform. Other exercises are possible without diverting from the advantages of the disclosure for providing a multifunction exercise device that combines the benefits of bodyweight suspension strength exercises with rope oscillation exercises in one convenient product and system. For example, some of these other exercise may include, but not limited to, chest press exercises, lateral raises, overhead triceps extensions, exercises w/feet suspended, incline bicep curls, lateral press downs, single leg hip/hamstring curls, vertical sit ups, various squats and lunge exercises, etc.

Reference throughout this specification to "one embodiment" or "an embodiment" means that a particular feature, structure, or characteristic described in connection with the embodiment is included in at least one embodiment of the disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the foregoing specification, a detailed description has been given with reference to specific exemplary embodiments. It will, however, be evident that various modifications and changes may be made thereto without departing from the broader spirit and scope of the disclosure as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

What is claimed is:

1. A battle rope strength trainer system comprising:

an anchor fixed to a structure;

a rope, 20-30 feet in length, having a first end and two free ends, the first end is attachable to the anchor and the two free ends are positioned opposite to the first end; and a mounting device coupled to the structure above the anchor, the mounting device including two projections, wherein each projection is adapted to receive a respective portion of the rope associated with each of the two free ends to enable movement of the rope for a plurality of exercises, wherein the system capable of being arranged into multiple configurations including at least:

a configuration in which the first end of the rope is attached to the anchor so that a user can perform exercises in which the user holds a respective free end of the rope in each hand and moves the user's arms and upper body thereby floating portions of the rope between the first end and the two free ends; and a configuration in which the first end of the rope is attached to the anchor and central portions of the rope are each wrapped around respective projections of the mounting device, thereby allowing the user to:

hold a respective free end of the rope in each hand so that the user can suspend his or her upper body from the two free ends of the rope, or attach one or more feet to a respective free end of the rope so that the user can suspend the one or more feet while performing exercises.

2. The battle rope strength trainer system of claim 1, wherein the rope is comprised of nylon.

3. The battle rope strength trainer system of claim 1, wherein at least one of the plurality of exercises comprises a battle rope oscillation exercise using the rope.

4. The battle rope strength trainer system of claim 1, wherein at least one of the plurality of exercises comprises a slam exercise using the rope.

5. The battle rope strength trainer system of claim 1, wherein at least one of the plurality of exercises comprises a chest fly exercise using the rope.

6. The battle rope strength trainer system of claim 1, wherein at least one of the plurality of exercises comprises a reverse crunch exercise using the rope.

7. The battle rope strength trainer system of claim 1, further comprising a handle attached to each of the two free ends of the rope.

8. The battle rope strength trainer system of claim 7, further comprising a strap coupled to the handle.

9. The battle rope strength trainer system of claim 8, wherein the strap is arranged to receive a hand or foot of the user.

10. The battle rope strength trainer system of claim 8, wherein the strap is comprised of a nylon material.

11. The battle rope strength trainer system of claim 7, further comprising a pad coupled to each handle.

12. The battle rope strength trainer system of claim 11, wherein the pad is comprised of a foam material.

13. The battle rope strength trainer system of claim 1, wherein at least one of the plurality of exercises comprises a bicep curling exercise using the rope.

14. The battle rope strength trainer system of claim 1, wherein the mounting device is positioned at an adjustable height with respect to the anchor.

15. The battle rope strength trainer system of claim 1, wherein the mounting device comprise a first anchor point and a second anchor point.

16. The battle rope strength trainer system of claim 15, wherein the first anchor point is adapted to receive the portion of the rope associated with at least one of the two free ends.

17. The battle rope strength trainer system of claim 15, wherein the second anchor point is adapted to receive the portion of the rope associated with at least one of the two free ends.

18. A battle rope strength trainer system comprising:

an anchor fixed to a wall, door or bar;

a rope, 20-30 feet in length, having a first end and two free ends, the first end is attachable to the anchor and the two free ends are positioned opposite to the first end;

a handle attached to each of the two free ends of the rope a mounting device coupled to the wall, door, or bar above the anchor, wherein the mounting device includes two projections wherein each projection is adapted to receive a respective portion of the rope associated with each of the two free ends to enable movement of the rope for a plurality of exercises, wherein the system capable of being arranged into multiple configurations including at least:

a configuration in which the first end of the rope is attached to the anchor so that a user can hold the two free ends of the rope with the handles and perform rope oscillation exercises; and a configuration in which the first end of the rope is attached to the anchor and central portions of the rope are each wrapped around respective projections of the mounting device, thereby allowing the user to suspend his or her body from the handles of the rope; and a weight clamp coupled to the handle to increase resistance of the rope.

19. A battle rope strength trainer system comprising:

an anchor fixed to a wall, door, or bar;

a rope, 20-30 feet in length, having a first end and two free ends, the first end is attachable to the anchor and the two free ends are positioned opposite to the first end;

a handle attached to each of the two free ends of the rope;

a mounting device coupled to the wall, door, or bar above the anchor, wherein the mounting device includes a first anchor point at a first height and a second anchor point at a second height, wherein the first and second anchor points each comprise a set of two projections that are adapted to receive a respective portion of the rope associated with each of the two free ends to enable movement of the rope for a plurality of exercises, wherein the system is capable of being arranged into multiple configurations including at least:

a configuration in which the first end of the rope is attached to the anchor so that a user can hold the two free ends of the rope with the handles and perform rope oscillation exercises; and a configuration in which the first end of the rope is attached to the anchor and central portions of the rope are each wrapped around respective projections of the first or second anchor points, thereby allowing the user to suspend his or her body from the handles of the rope.

* * * * *